US011435031B2

(12) United States Patent
Park et al.

(10) Patent No.: US 11,435,031 B2
(45) Date of Patent: Sep. 6, 2022

(54) PRESSURE VESSEL

(71) Applicant: SUNGWOO HITECH Co., LTD., Busan (KR)

(72) Inventors: Byung Hag Park, Busan (KR); Min Gwan Bae, Busan (KR)

(73) Assignee: SUNGWOO HITECH CO., LTD., Busan (KR)

( * ) Notice: Subject to any disclaimer, the term of this patent is extended or adjusted under 35 U.S.C. 154(b) by 29 days.

(21) Appl. No.: 17/166,267

(22) Filed: Feb. 3, 2021

(65) Prior Publication Data

US 2022/0214013 A1 Jul. 7, 2022

(30) Foreign Application Priority Data

Jan. 4, 2021 (KR) ..... 10-2021-0000442

(51) Int. Cl.
*F17C 1/00* (2006.01)

(52) U.S. Cl.
CPC ..... *F17C 1/00* (2013.01); *F17C 2201/0109* (2013.01); *F17C 2203/0604* (2013.01); *F17C 2205/0305* (2013.01); *F17C 2221/011* (2013.01); *F17C 2221/012* (2013.01); *F17C 2221/014* (2013.01); *F17C 2221/033* (2013.01); *F17C 2223/036* (2013.01)

(58) Field of Classification Search
CPC ..... F17C 1/00; F17C 2201/0109; F17C 2203/0604; F17C 2205/0305; F17C 2221/011; F17C 2221/012; F17C 2221/014; F17C 2221/033; F17C 2223/036; F17C 2205/0302
USPC ..... 220/581, 586
See application file for complete search history.

(56) References Cited

U.S. PATENT DOCUMENTS

2007/0164561 A1 7/2007 Kwon et al.
2014/0144866 A1* 5/2014 Heo ..... F17C 13/002 215/45
2017/0284601 A1* 10/2017 Kusaba ..... F17C 1/04
2018/0003341 A1* 1/2018 Hwang ..... F17C 13/04

FOREIGN PATENT DOCUMENTS

EP 3489063 5/2019
KR 101806643 B1 * 12/2017
KR 20190061605 6/2019

* cited by examiner

*Primary Examiner* — Valentin Neacsu
*Assistant Examiner* — Laura E. Parker
(74) *Attorney, Agent, or Firm* — Lex IP Meister, PLLC

(57) ABSTRACT

Disclosed is a pressure vessel including a boss extension portion having a cylindrical shape in which a through hole is formed at a central part to pass therethrough and a boss flange portion formed below the boss extension portion and integrally expanding outward in a radial direction along a circumferential direction in which the through hole extends in a vertical direction inward in the radial direction, a liner portion having a container shape in which an accommodation space configured to communicate with the through hole is formed to accommodate a fluid therein while a top is insertion-injection molded and seal-coupled along a bottom surface of the boss flange portion, and a sealing portion seal-coupled to a boundary area between a bottom of the boss flange portion and a top of the liner portion to block a leakage of the fluid accommodated in the accommodation space.

9 Claims, 2 Drawing Sheets

PRESSURE VESSEL

CROSS-REFERENCE TO RELATED APPLICATION

This application claims priority to and the benefit of Korean Patent Application No. 10-2021-0000442, filed on Jan. 4, 2021, the disclosure of which is incorporated herein by reference in its entirety.

BACKGROUND

1. Field of the Invention

The present invention relates to a pressure vessel, and more particularly, to a pressure vessel having improved sealing performance.

2. Discussion of Related Art

Generally, gas storage vessels are necessary to store a variety of types of gases such as hydrogen, nitrogen, natural gas, and the like and to discharge stored gases as necessary. Particularly, since gases are in low storage density in a vessel, it is necessary to store gases at high pressure. A pressure vessel utilized in such a high-pressure environment is necessary.

For example, alternative fuel gas vehicles including fuel cell vehicles or compressed natural gas vehicles have storage system structures which vary according to a storage method of fuel gases. Currently, in consideration of a cost, a weight, and simplicity of a storage system, a compressed gas type storage method has been in the spotlight. However, since a gaseous fuel has a low energy storage density, in order to secure more mileage, it is necessary to increase a storage amount or to increase a storage pressure. Particularly, in the case of a vehicle, since there is a limitation in increasing a size of a storage tank due to a limited gas storage system mounting space, it is very significant in a tank technique to safely store gases at a higher pressure.

Also, in the case of a composite tank among fuel gas storage tanks, in order to withstand an internal pressure generated by a compressed gas, a shell is reinforced using fiber-reinforced composites having high specific strength and specific stiffness and a liner configured to maintain gas tightness is inserted therein. Here, forms of fuel gas storage tanks are classified according to materials of liners. A tank in which a metallic liner such as aluminum is inserted is sorted as a type 3, and a tank in which a high-density polymer liner is inserted is sorted as a type 4.

In detail, the type 3 has relatively high stability but has disadvantages such as a high price and low fatigue resistance. On the other hand, in comparison to the type 3, the type 4 has advantages such as a low price and excellent fatigue resistance but has safety problems such as a leakage of hydrogen, decreasing transmission-resistant performance, and the like. Particularly, since a metallic nozzle applied to mount an external valve and a plastic material of a body differ from each other, soundness of air-tightness at a boss extension part is significant.

That is, even when a pressure vessel is manufactured using a plastic liner, it is necessary to use a metallic material or a non-metallic material, which differs from the liner, for a nozzle boss. Accordingly, there is a problem of degradation of adhesion between the metallic or non-metallic nozzle boss and the plastic liner which does not occur when a metallic liner is used.

Here, to redeem the above problems, a plastic clamp is generally used for clamping a plastic liner to a metallic nozzle boss. However, this causes another problem of a difficulty in installing the clamp in the plastic liner.

As another method, a method is used of forming a groove in a nozzle boss and insertion-molding the nozzle boss in the plastic liner. However, it is not easy to implement a perfect adhesion state.

Accordingly, it is urgent to research to prevent abnormal leakage of an internally accommodated fluid by increasing adhesion between a plastic liner and a metallic or nonmetallic nozzle boss.

RELATED ART DOCUMENT

Patent Document

Korean Patent Registration No. 10-1806643

SUMMARY OF THE INVENTION

The present invention is directed to providing a pressure vessel having improved sealing performance.

According to an aspect of the present invention, there is provided a pressure vessel including a boss portion including a boss extension portion having a cylindrical shape in which a through hole is formed at a central part to pass therethrough and a boss flange portion formed below the boss extension portion and integrally expanding outward in a radial direction along a circumferential direction in which the through hole extends in a vertical direction inward in the radial direction, a liner portion having a container shape in which an accommodation space configured to communicate with the through hole is formed to accommodate a fluid therein while a top is insertion-injection molded and seal-coupled along a bottom surface of the boss flange portion, and a sealing portion seal-coupled to a boundary area between a bottom of the boss flange portion and a top of the liner portion to block a leakage of the fluid accommodated in the accommodation space.

According to another aspect of the present invention, there is provided a pressure vessel including a boss portion including a boss extension portion having a cylindrical shape in which a through hole is formed at a central part to pass therethrough along a vertical direction and a boss flange portion formed below the boss extension portion and integrally expanding outward in a radial direction along a circumferential direction, in which the through hole extends in a vertical direction inward in the radial direction, and below which a shape-matching and pressing groove divided and spaced while surrounding a radial outside of the through hole and having a cross section with a diameter continuously increasing toward a radial inside along a circumferential direction is formed to be recessed, a liner portion having a container shape in which an accommodation space configured to communicate with the through hole is formed to accommodate a fluid therein while a top is insertion-injection molded and seal-coupled along a bottom surface of the boss flange portion and a shape-matching expansion portion having a diameter increasing toward an end is formed on a facing part with the shape-matching and pressing groove along a circumferential direction to be pressed against and shape-matched with the shape-matching and pressing groove, and a sealing portion sealed and coupled to a boundary area between a bottom of the boss flange portion and a top of the liner portion to block a leakage of the fluid accommodated in the accommodation space.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Hereinafter, a pressure vessel according to an exemplary embodiment of the present invention will be described in detail with reference to the drawings.

Figure 1:
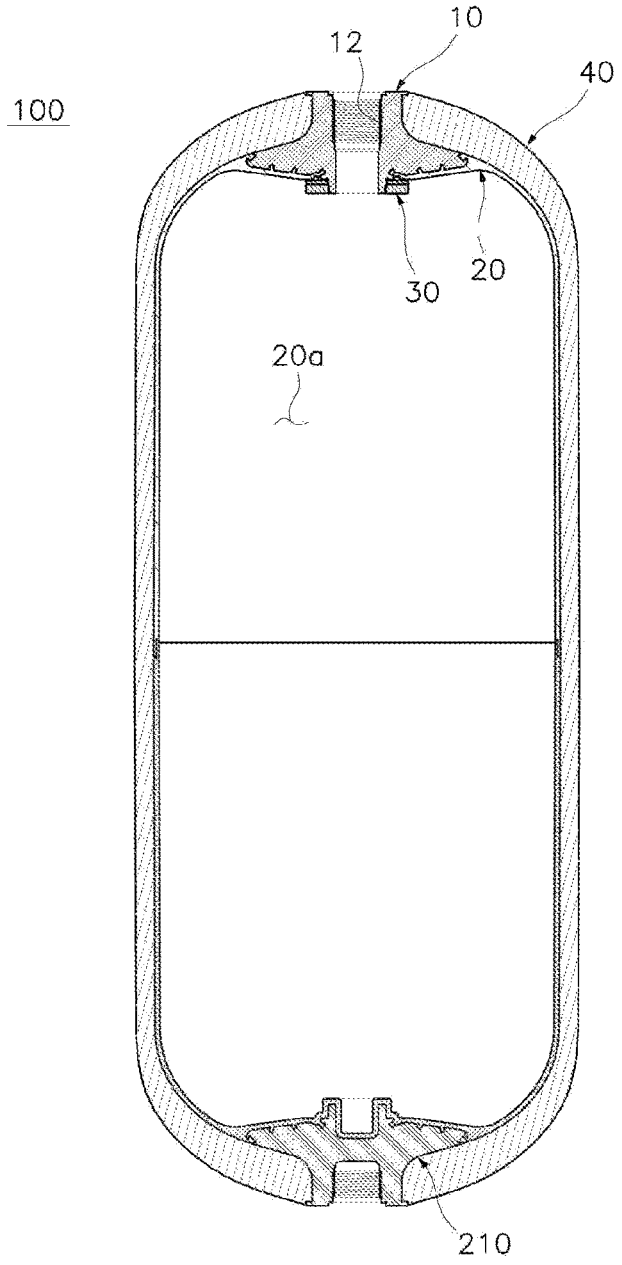
FIG. 1 is a cross-sectional view of a pressure vessel according to one embodiment of the present invention.
Figure 2:
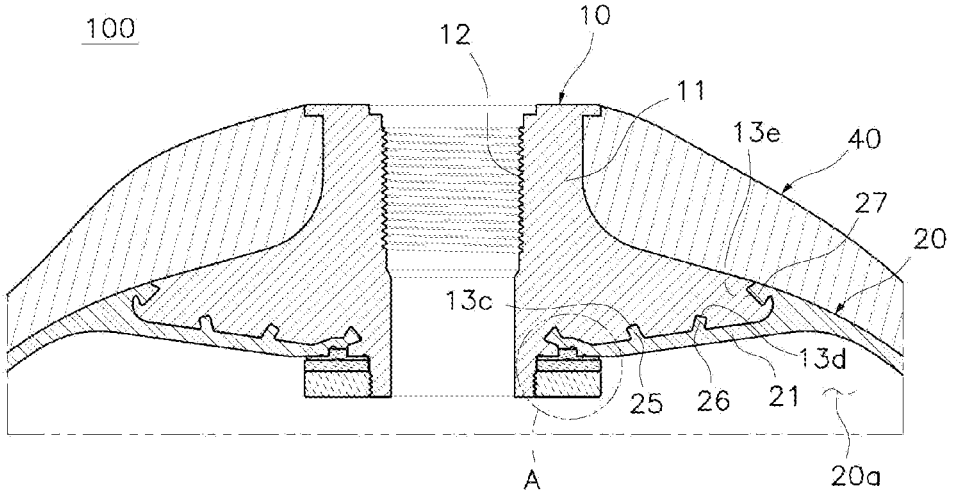
FIG. 2 is a partial cross-sectional view of the pressure vessel according to one embodiment of the present invention.
Figure 3:
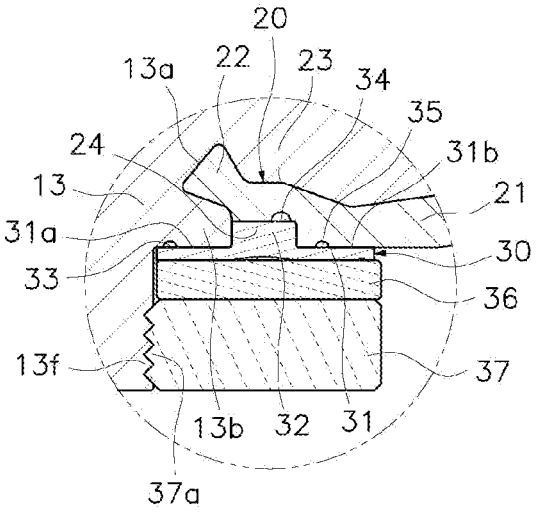
FIG. 3 is an enlarged view illustrating part A of FIG. 2.

FIG. 1 is a cross-sectional view of a pressure vessel according to one embodiment of the present invention, FIG. 2 is a partial cross-sectional view of the pressure vessel according to one embodiment of the present invention, and FIG. 3 is an enlarged view illustrating part A of FIG. 2.

As shown in FIGS. 1 and 3, a pressure vessel 100 according to one embodiment of the present invention includes a boss portion 10, a liner portion 20 and a sealing portion 30.

Here, the pressure vessel 100 is a vessel used for accommodating a variety of fluids such as oxygen, natural gas, nitrogen, hydrogen, and the like and may be provided to selectively suction and discharge one of the fluids repetitively. Here, the fluid may be stored in the pressure vessel 100 at a high pressure of 700 bars.

Meanwhile, the boss portion 10 may include a boss extension portion 11 having a cylindrical shape and including a through hole 12 formed at a central part thereof to pass therethrough in a vertical direction. Also, the boss portion 10 may include a boss flange portion 13 integrally expanding outward from a bottom of the boss extension portion 11 in a radial direction along a circumferential direction and in which the through hole 12 extends in a vertical direction inward in the radial direction.

Here, the boss extension portion 11 and the boss flange portion 13 are integrally formed and it may be understood that the boss extension portion 11 is formed above the boss portion 10 and the boss flange portion 13 is formed below the boss portion 10.

Here, an outer surface of the boss extension portion 11 may be formed to be rounded and recessed concavely inward in a radial direction along a circumferential direction from a top end toward a boundary area with the boss flange portion 13 therebelow.

Also, a top surface of the boss flange portion 13 may be formed to have a shape expanding outward in a radial direction along a circumferential direction from a boundary area with the boss extension portion 11 toward a bottom end.

Here, the boss portion 10 including the boss extension portion 11 and the boss flange portion 13 may be manufactured by processing steel which is metallic, aluminum which is non-metallic, or the like, but a material thereof is not limited thereto.

Also, the through hole 12 may be formed to pass through the boss extension portion 11 and the boss flange portion 13 along a vertical direction and may have a top end opened outward and a bottom end configured to communicate with a first accommodation space 20*a* inside the liner portion 20.

In addition, the through hole 12 may include a screw thread formed on an upper inner circumferential surface to be fastened to an external device (not shown) so as to prevent a leakage of a fluid when the fluid flows into or is discharged outward from the pressure vessel 100.

Meanwhile, the pressure vessel 100 may further include a composite cover portion 40 having a top pressed against and covering and surrounding the outer surface of the boss extension portion 11 and the top surface of the boss flange portion 13.

Also, in the composite cover portion 40, an inner surface at a center in a vertical direction which extends downward from the top pressed against and covering the boss portion 10 is provided to surround the liner portion 20.

The composite cover portion 40 may be formed by impregnating reinforced fiber such as carbon fiber, glass fiber, synthetic polyamide fiber, and the like into a resin such as an epoxy resin and the like to be wound or laminated, with a preset thickness, outside the boss portion 10 and the liner portion 20.

Accordingly, the composite cover portion 40 is wound or laminated outside the boss portion 10 and the liner portion 20 so that pressure resistance of the accommodation space 20*a* inside the liner portion 20 may be improved.

Meanwhile, the liner portion 20 may include the accommodation space 20*a* provided to have a container shape to communicate with the through hole 12 so as to accommodate a fluid therein while the top is insertion-injection molded and coupled and sealed along a bottom surface of the boss flange portion 13. Also, the liner portion 20 may have a bottom insertion-injection molded and coupled and sealed along a top surface of a boss tail portion 210. Here, the boss tail portion 210 may include the same material as the boss portion 10.

Here, the liner portion 20 may include a synthetic resin material different from that of the boss portion 10. Here, the boss portion 10 may be inserted between an upper mold (not shown) and a lower mold (not shown), and a separation space (not shown) configured to communicate with the boss portion 10 may be formed between the upper mold and the lower mold.

Also, a synthetic resin is injected into the separation space (not shown) and hardened so that the liner portion 20 may be manufactured through insertion-injection molding. Also, the top and the bottom of the liner portion 20 may be separately manufactured and coupled to each other through laser welding.

Meanwhile, at a bottom of the boss flange portion 13, a shape-matching and pressing groove 13*a* divided and spaced while surrounding a radial outside of the through hole 12 and having a cross section with a diameter continuously increasing in a direction toward a radial inside along a circumferential direction may be formed to be recessed.

Here, the shape-matching and pressing groove 13*a* may be recessed to have a reversed-trapezoidal cross section. Also, the shape-matching and pressing groove 13*a* may be formed to be tilted upward in a direction toward a radial inside. For example, referring to FIG. 3, a bottom surface of the shape-matching and pressing groove 13*a* may be formed to be leveled with a lower surface and may include an inner surface and a top surface which are tilted.

In addition, in the liner portion 20, a shape-matching expansion portion 22 may be formed on a part facing the shape-matching and pressing groove 13*a* through insertion-injection molding to be pressed against and shape-matched with the shape-matching and pressing groove 13*a*. Here, the shape-matching expansion portion 22 may be formed on the part facing the shape-matching and pressing groove 13*a* of the liner portion 20 to have a diameter gradually increasing in a direction toward a radial inside along a circumferential direction so as to be pressed against and shape-matched with the shape-matching and pressing groove 13*a*.

In detail, a liner extension portion 21 extending inward in a radial direction along the bottom surface of the boss flange portion 13 and having a top surface pressed against the bottom surface of the boss flange portion 13 may be formed above the liner portion 20. Also, an expansion-extension portion 23 may be formed at a radial inner end of the liner extension portion 21 to extend integrally in an outline of the top surface corresponding to the bottom surface of the boss flange portion 13.

Also, the shape-matching expansion portion 22 may further extend toward a radial inside from an inner end of the expansion-extension portion 23 and be formed to be tilted upward in a direction toward a radial inside. For example, referring to FIG. 3, a bottom surface of the shape-matching expansion portion 22 may be formed to be leveled with a lower surface and may include an inner surface and a top surface which are tilted. Also, the shape-matching expansion portion 22 may be manufactured through insertion-injection molding to be pressed against and shape-matched with the shape-matching and pressing groove 13*a*.

Accordingly, the shape-matching expansion portion 22 of the liner portion 20 is pressed against and shape-matched with the shape-matching and pressing groove 13*a* formed to be recessed from the bottom of the boss flange portion 13 and have a cross section with a reversed-trapezoidal diameter continuously increasing toward a radial inside along a circumferential direction. Accordingly, since a coupling force with the boss portion 10 may be firmly maintained even when the liner portion 20 is contracted and relaxed repetitively, sealing performance may be notably improved.

Meanwhile, a sealing step 13*b* protruding outward in a radial direction along a circumferential direction from a bottom of the shape-matching and pressing groove 13*a* may be formed at the boss flange portion 13.

Also, a sealing groove 24 recessed upward from an area facing a radially outer end of the sealing step 13*b* may be formed at a bottom of an inner end of the liner portion 20 in a radial direction which extends along the bottom surface of the boss flange portion 13.

Here, the sealing groove 24 may be formed to be recessed upward from a bottom surface of the expansion-extension portion 23. Here, the sealing groove 24 may be formed to have a shape corresponding to a shape of a mold of the liner portion 20 in insertion-injection molding and may be post-processed as necessary.

Also, a height of a top surface of an inside of the sealing groove 24 may be set to be a height corresponding to a central side between a top end and a bottom end of the sealing step 13*b*.

Also, a top of the radially outer end of the sealing step 13*b* may come into surface contact with and be pressed against the inner end of the expansion-extension portion 23. Here, the sealing portion 30 may be disposed to be pressed against a bottom of a boundary area between the radially outer end of the sealing step 13*b* and the inner end of the expansion-extension portion 23.

Meanwhile, the sealing portion 30 may be airtightly coupled to a boundary area between the bottom of the boss flange portion 13 and a top of the liner portion 20 to block a leakage of a fluid accommodated in the accommodation space 20*a*.

Here, the sealing portion 30 may include an elastic material including ethylene propylene diene monomer (EPDM). Here, EPDM is synthetic rubber having high ozone resistance, weatherability, heat resistance, solvent resistance, and the like, having a specific gravity smaller than other synthetic resins, capable of being highly filled with a filler, oil, and the like, and having highly excellent economic feasibility.

Also, the sealing portion 30 may include a sealing plate 31 and a sealing shape-matching portion 32 which are integrally formed. Here, the sealing plate 31 and the sealing shape-matching portion 32 may include elastic materials including EPDM.

Here, the sealing plate 31 may be provided to have a ring shape extending and divided and spaced apart from the through hole 12 to surround an outside of the through hole 12 in a radial direction along a circumferential direction.

Also, a top surface 31*a* of the sealing plate 31 which is inward in a radial direction may come into surface contact with a bottom surface of the sealing step 13*b*. Simultaneously, a top surface 31*b* of the sealing plate 31 which is outward in the radial direction may come into surface contact with a bottom surface of the liner extension portion 21 formed above the liner portion 20.

Also, the sealing shape-matching portion 32 may extend integrally from a top between the top surface 31*a* and the top surface 31*b* of the sealing plate 31 inward and outward in the radial direction, respectively.

Also, a radially inner surface of the sealing shape-matching portion 32 may come into surface contact with the radially outer end of the sealing step 13*b* while simultaneously a top surface thereof comes into surface contact with and is pressed against and shape-matched with the sealing groove 24.

Accordingly, the top surface of the sealing plate 31 may come into surface contact with the sealing step 13*b* and the bottom surface of the liner extension portion 21. Simultaneously, since the sealing shape-matching portion 32 extending integrally upward from the top of the sealing plate 31 comes into surface contact twice with the outer end of the sealing step 13*b* and the sealing groove 24, sealing performance may be notably improved.

Meanwhile, a plurality of sealing protrusions including a first sealing protrusion 33, a second sealing protrusion 34, and a third sealing protrusion 35 may be formed on the sealing plate 31 and the sealing shape-matching portion 32. A facing surface which is pressurized against and comes into contact with ends of such sealing protrusions may be formed to be flat.

The first sealing protrusion 33 integrally extending and protruding upward toward the bottom surface of the sealing step 13*b* may be continuously formed on the top surface 31*a* of the sealing plate 31 inward in the radial direction along a circumferential direction.

Here, a top end of the first sealing protrusion 33 may be elastically pressurized toward the bottom surface of the sealing step 13*b*. Here, while the top surface 31*a* of the sealing plate 31 inward in the radial direction comes in surface contact with the bottom surface of the sealing step 13*b*, a sealing force of an area in which the first sealing protrusion 33 is pressurized upward may be further increased.

Also, the second sealing protrusion 34 integrally extending and protruding upward toward the sealing groove 24 may be continuously formed on the top surface of the sealing shape-matching portion 32 along a circumferential direction. Here, a top end of the second sealing protrusion 34 may be elastically pressurized toward the sealing groove 24. In addition, while the top surface of the sealing shape-matching portion 32 comes into surface contact with the sealing groove 24, a sealing force of an area in which the second sealing protrusion 34 is pressurized upward may be further increased.

In addition, the third sealing protrusion 35 integrally extending and protruding upward toward the bottom surface of the liner extension portion 21 may be continuously formed on the top surface 31*b* of the sealing plate 31 outward in the radial direction along a circumferential direction.

Here, a top end of the third sealing protrusion 35 may be elastically pressurized toward the bottom surface of the liner extension portion 21. Here, while the top surface 31*b* of the sealing plate 31 outward in the radial direction comes in surface contact with the bottom surface of the liner extension portion 21, a sealing force of an area in which the third sealing protrusion 35 is pressurized upward may be further increased.

That is, the top ends of the first sealing protrusion 33, the second sealing protrusion 34, and the third sealing protrusion 35 may be multiply pressurized upward toward the sealing step 13*b*, the sealing groove 24, and the liner extension portion 21, and the sealing forces may be focused on the respective pressurized areas.

Accordingly, the first sealing protrusion 33, the second sealing protrusion 34, and the third sealing protrusion 35 are formed on the top surfaces 31*a* and 31*b* of the sealing plate 31 inward and outward in the radial direction and the top surface of the sealing shape-matching portion 32.

Accordingly, since the top ends of the first sealing protrusion 33, the second sealing protrusion 34, and the third sealing protrusion 35 may be multiply pressurized intensively toward the sealing step 13*b*, the sealing groove 24, and the liner extension portion 21, a fluid leakage may be stably blocked.

Meanwhile, a bottom surface of the sealing plate 31 may be formed to be a planarized surface. Also, the sealing portion 30 may further include a sealing pressurizing portion 36 having a ring shape in which a top surface comes into surface contact with the bottom surface of the sealing plate 31 and a radial inner end is pressed against the boss flange portion 13.

Also, the sealing portion 30 may further include a pressurizing nut 37 having a ring shape in which a top surface comes into surface contact with a bottom surface of the sealing pressurizing portion 36 and a fastening screw thread 37*a* is formed on a radial inside.

Here, a screw coupling portion 13*f* may be formed on one side of a bottom of the boss flange portion 13 facing a radial inside of the pressurizing nut 37 to allow the fastening screw thread 37*a* to be coupled thereto.

Accordingly, as the pressurizing nut 37 is fastened and tightened from a bottom to a top, the sealing pressurizing portion 36, the sealing plate 31, and the sealing shape-matching portion 32 are pressurized upward to be pressed against a boundary area between the boss portion 10 and the liner portion 20.

Meanwhile, a first tilted groove 13*c* recessed to be tilted inward in a radial direction in an upward direction may be formed on the bottom surface of the boss flange portion 13. Also, a second tilted groove 13*d* recessed to be tilted outward in a radial direction in an upward direction from a position spaced radially outward apart from the first tilted groove 13*c* may be formed on the bottom surface of the boss flange portion 13.

That is, the first tilted groove 13*c* and the second tilted groove 13*d* may be recessed from both sides in a radial direction that is a direction becoming farther away from each other in an upward direction. Here, a first recession angle between the first tilted groove 13*c* and the liner extension portion 21 may be set to correspond to a second recession angle between the second tilted groove 13*d* and the liner extension portion 21. On a case-by-case basis, the first recession angle may be set to be different from the second recession angle.

Also, a first tilted protrusion 25 and a second tilted protrusion 26 which are shaped-matched with and inserted into the first tilted groove 13*c* and the second tilted groove 13*d*, respectively, may be formed, through insertion-injection molding, on a top surface of the liner extension portion 21 formed above the liner portion 20. Here, the first tilted protrusion 25 and the second tilted protrusion 26 may be integrally formed to extend from the liner extension portion 21.

Here, the first tilted protrusion 25 may extend to be tilted inward in a radial direction from one side of the liner extension portion 21 in an upward direction and be shape-matched with the first titled groove 13*c*.

Also, the second tilted protrusion 26 may extend to be titled outward in a radial direction from the liner extension portion 21 at a position spaced radially outward apart from the first tilted protrusion 25 in an upward direction and be shape-matched with the second tilted groove 13*d*. That is, the first tilted protrusion 25 and the second tilted protrusion 26 may extend to both sides in a radial direction that is a direction becoming farther away from each other in an upward direction.

Accordingly, the first tilted groove 13*c* recessed to be tilted inward in the radial direction in the upward direction and the second tilted groove 13*d* recessed to be tilted outward in the radial direction toward the top while being spaced apart from the first tilted groove 13*c* are formed on the bottom surface of the boss flange portion 13.

Also, the first tilted protrusion 25 and the second tilted protrusion 26 of the liner extension portion 21 are insertion-injection molded and shape-matched with the first tilted groove 13*c* and the second tilted groove 13*d*. Accordingly, occurrence of a vertical gap and deformation between the boss portion 10 and the liner portion 20 may be minimized so as to minimize a fluid leakage.

Meanwhile, a peripheral shape-matching groove 13*e* having a cross section with a diameter continuously increasing in a direction toward a radial inside along a circumferential direction may be formed to be recessed from a radially outer end of the boss flange portion 13. Here, the peripheral shape-matching groove 13*e* may be formed to be recessed from a top surface of the radially outer end of the boss flange portion 13.

Also, a peripheral shape-matching protrusion 27 having a diameter increasing in a direction toward a radial inside along a circumferential direction to be pressed against and shape-matched with the peripheral shape-matching groove 13*e* may extend and protrude, through insertion-injection molding, above the liner portion 20 facing the peripheral shape-matching groove 13*e*.

In detail, the peripheral shape-matching protrusion 27 may primarily extend upward from a radial outside of the liner extension portion 21 and secondarily extend and be bent toward the peripheral shape-matching groove 13*e* so as to surround the radially outer end of the boss flange portion 13. Here, the peripheral shape-matching protrusion 27 may be insertion-injection molded and pressed against and shape-matched with the peripheral shape-matching groove 13*e*.

Here, on a case-by-case basis, the peripheral shape-matching groove 13*e* may be formed to be recessed from the radially outer end of the boss flange portion 13 so that a diameter of a cross section may continuously increase in a downward direction along a circumferential direction. Also, on a case-by-case basis, the peripheral shape-matching protrusion 27 may extend and protrude from above the liner portion 20 so that a diameter may increase in a downward direction along a circumferential direction.

Accordingly, the peripheral shape-matching protrusion 27 of the liner portion 20 is insertion-injection molded and shape-matched with the peripheral shape-matching groove 13*e* recessed from the radially outer end of the boss flange portion 13 in which the diameter of the cross section of the peripheral shape-matching groove 13*e* continuously increases radially inward along a circumferential direction. Accordingly, occurrence of a vertical gap and deformation between the boss portion 10 and the liner portion 20 may be minimized so as to minimize a fluid leakage.

Also, since the first tilted protrusion 25, the second tilted protrusion 26, and the peripheral shape-matching protrusion 27 of the liner portion 20 firmly fix the boss portion 10 in multiple directions, a fixing force may be notably improved.

According to the embodiment of the present invention, effects are provided as follows.

First, since a shape-matching extension portion of a liner portion is pressed against and shape-matched with a shape-matching and pressing groove formed below a boss flange portion to be recessed and have a cross section having a diameter continuously increasing in an inverted trapezoidal shape inward in a radial direction along a circumferential direction, a coupling force with a boss portion is firmly maintained even when the liner portion is contracted and released so that air-tightness may be notably improved.

Second, since a top surface of a sealing plate comes into surface contact with a sealing step and a bottom surface of a liner extension portion while a sealing shape-matching portion extending upward integrally from a top of the sealing plate simultaneously comes into surface contact twice with an outer end of the sealing step and a sealing groove, sealing performance may be notably improved.

Third, since a plurality of sealing protrusions continuously and multiply protrude upward from an inner top surface and an outer top surface of the sealing plate and a top surface of the sealing shape-matching portion along a circumferential direction so that each of top ends thereof multiply and intensively pressurize the sealing step, the sealing groove, and the liner extension portion, a leakage of a fluid may be stably blocked.

Fourth, since a first tilted protrusion and a second tilted protrusion of the liner extension portion are insertion-injection molded and shape-matched with a first tilted groove recessed from a bottom surface of the boss flange portion to be tilted inward in a radial direction in an upward direction and a second tilted groove recessed to be tilted outward in a radial direction, respectively, a vertical gap and deformation between the boss portion and the liner portion may be minimized so as to minimize a fluid leakage.

Fifth, when an outer shape-matching protrusion of the liner portion is insertion-injection molded and shape-matched with an outer shape-matching groove recessed from an outer end of the boss flange portion to have a cross section with a diameter continuously increasing inward in a radial direction along a circumferential direction, a first tilted protrusion, a second tilted protrusion, and the outer shape-matching protrusion may firmly fix the boss portion in multiple directions so as to notably improve a fixing force.

As described above, the present invention is not limited to the above-described embodiment and may be modified by one of ordinary skill in the art without departing from the scope of the claims of the present invention and such modifications are included within the scope of the present invention.

What is claimed is:

1. A pressure vessel comprising:

a boss portion comprising a boss extension portion having a cylindrical shape in which a through hole is formed at a central part to pass therethrough and a boss flange portion formed below the boss extension portion and integrally expanding outward in a radial direction along a circumferential direction in which the through hole extends in a vertical direction;

a liner portion having a container shape in which an accommodation space configured to communicate with the through hole is formed to accommodate a fluid therein while a top of the liner portion is insertion-injection molded and seal-coupled along a bottom surface of the boss flange portion; and a sealing portion seal-coupled to a boundary area between a bottom of the boss flange portion and the top of the liner portion to block a leakage of the fluid accommodated in the accommodation space, wherein a sealing step protruding outward in the radial direction is formed along the circumferential direction on the boss flange portion, wherein a sealing groove facing a radially outer end of the sealing step is formed to be recessed upward below an inner end of the liner portion extending along the bottom surface of the boss flange portion, wherein the sealing portion comprises:

a sealing plate surrounding a radial outside of the through hole along a circumferential direction, wherein a radially inward top surface of the sealing plate contacts a bottom surface of the sealing step, and a radially outward top surface of the sealing plate, which is located outward than the radially inward top surface in the radial direction, contacts a bottom surface of a liner extension portion formed above the liner portion; and a sealing shape-matching portion integrally extending upward from a top of the sealing plate while a radially inner surface of the sealing shape-matching portion comes into surface contact with the radially outer end of the sealing step and a top surface of the sealing shape-matching portion is pressed against and shape-matched with the sealing groove, wherein a first sealing protrusion and a third sealing protrusion extend upward from the radially inward top surface and the radially outward top surface of the sealing plate, respectively, and wherein a second sealing protrusion integrally extending and protruding toward the sealing groove is formed along a circumferential direction on the top surface of the sealing shape-matching portion so that a top end of the second sealing protrusion is elastically pressurized toward the sealing groove.

2. The pressure vessel of claim 1, wherein a shape-matching and pressing groove surrounding a radial outside of the through hole and having a cross section continuously increasing toward an end of the shape-matching and pressing groove is formed along the circumferential direction to be recessed from the bottom surface of the boss flange portion, and wherein a shape-matching expansion portion is formed on a part of the liner portion facing the shape-matching and pressing groove through insertion-injection molding to be pressed against and shape-matched with the shape-matching and pressing groove.

3. The pressure vessel of claim 1, wherein the first sealing protrusion integrally extends and protrudes from the radially inward top surface of the sealing plate toward the bottom surface of the sealing step along a circumferential direction so that a top end of the first sealing protrusion is elastically pressurized toward the bottom surface of the sealing step.

4. The pressure vessel of claim 1, wherein the third sealing protrusion integrally extends and protrudes from the radially outward top surface of the sealing plate toward a bottom surface of the liner extension portion along a circumferential direction so that a top end of the third sealing protrusion is elastically pressurized toward the bottom surface of the linear extension portion.

5. The pressure vessel of claim 1, wherein a bottom surface of the sealing plate is formed to be a planarized surface, and wherein the sealing portion further comprises a sealing pressurizing portion having a ring shape in which a top surface comes into surface contact with the bottom surface of the sealing plate and a radially inner end is pressed against the boss flange portion.

6. The pressure vessel of claim 5, wherein the sealing portion further comprises a pressurizing nut having a ring shape in which a top surface comes into surface contact with a bottom surface of the sealing pressurizing portion and a fastening screw thread is formed on a radial inside, and wherein a screw coupling portion is formed on one side of a bottom of the boss flange portion facing the radial inside of the pressurizing nut to allow the fastening screw thread to be coupled thereto.

7. The pressure vessel of claim 1, wherein a height of a top surface of the sealing groove is set to be a height corresponding to a central part between a top end and a bottom end of the sealing step.

8. The pressure vessel of claim 1, wherein a first tilted groove is formed to be recessed in the bottom surface of the boss flange portion to be tilted inward in a radial direction in an upward direction and a second tilted groove spaced outward apart from the first tilted groove in a radial direction is formed to be recessed to be tilted outward in the radial direction in the upward direction, and wherein a first tilted protrusion and a second tilted protrusion which are inserted into and shape-matched with the first tilted groove and the second tilted groove, respectively, are formed on a top surface of the liner extension portion formed above the liner portion.

9. The pressure vessel of claim 1, wherein a peripheral shape-matching groove having a cross section continuously increasing toward an end of the peripheral shape-matching groove is formed along the circumferential direction to be recessed from a radially outer end of the boss flange portion, and wherein a peripheral shape-matching protrusion having a diameter increasing toward a radial inside along a circumferential direction extends and protrudes from a top of the liner portion facing the peripheral shape-matching groove to be pressed against and shape-matched with the peripheral shape-matching groove.

* * * * *